US006397120B1

(12) United States Patent
Goldman

(10) Patent No.: US 6,397,120 B1
(45) Date of Patent: May 28, 2002

(54) USER INTERFACE AND METHOD FOR MANIPULATING SINGULARITIES FOR AUTOMATIC EMBROIDERY DATA GENERATION

(76) Inventor: David A. Goldman, 3105 Knapp Rd., Vestal, NY (US) 13850

( * ) Notice: Subject to any disclaimer, the term of this patent is extended or adjusted under 35 U.S.C. 154(b) by 0 days.

(21) Appl. No.: 09/476,245

(22) Filed: Dec. 30, 1999

(51) Int. Cl.[7] ..... G06F 19/00; D05B 21/00
(52) U.S. Cl. ..... 700/138; 112/102.5; 112/475.19
(58) Field of Search ..... 700/138, 136, 700/137, 130, 131, 132, 143; 112/102.5, 470.06, 475.19, 470.04

(56) References Cited

U.S. PATENT DOCUMENTS 5,320,054 A * 6/1994 Asano ..... 112/102.5
5,563,795 A * 10/1996 Futamura et al. ..... 700/138
5,592,891 A * 1/1997 Muto ..... 112/475.19
5,668,730 A 9/1997 Tsonis et al.
5,740,056 A 4/1998 Futamura
5,839,380 A * 11/1998 Muto ..... 112/102.5
5,880,963 A * 3/1999 Futamura ..... 700/138

OTHER PUBLICATIONS

Fridtjof Stein and Gerard Medioni, "Structural Indexing: Efficient 2–D Object Recognition", IEEE Transactions on Pattern Analysis and Machine Intelligence, vol. 14, No. 12, Dec. 1992.

* cited by examiner

*Primary Examiner*—Peter Nerbun
(74) *Attorney, Agent, or Firm*—Salzman & Levy

(57) ABSTRACT

A user interface and method are disclosed for manipulating singular regions (termed singularities) for automatic embroidery data generation. A method is already known for automatically interpreting singular regions within an image so that embroidery data can be generated to recreate those singularities in an accurate and aesthetically pleasing manner. By using the present invention a user, with minimal effort, can gain greater control over the interpretation process. At the core of this extension is a single mouse click interface that allows the next best interpretation to be chosen easily. Additionally, the user may more precisely adjust interpretations, and provisions are made that allow automatic re-application of those adjustments to similar singularities encountered later.

20 Claims, 7 Drawing Sheets

Valid / Allowed Edit

Invalid / Disallowed Edit

USER INTERFACE AND METHOD FOR MANIPULATING SINGULARITIES FOR AUTOMATIC EMBROIDERY DATA GENERATION

FIELD OF THE INVENTION

The present invention pertains to the field of embroidery stitching and, more specifically, to manipulating singularities while automatically generating embroidery designs.

BACKGROUND OF THE INVENTION

The needle and thread were the early sewing tools needed for mending and repairing damaged clothing. It was then discovered that the needle could be used as an artistic tool to stitch patterns of thread that displayed colorful designs. This patterning of thread into designs has become known as the art of embroidery. Over time, embroidery designs have been displayed on various items ranging in size and complexity from simple handkerchiefs to shirts and quilts.

Just as the sewing machine has automated the task of sewing, various mechanisms have been used to automate the art of embroidery. For example, it has become known that a computer can be used to automatically generate embroidery designs. Typically an embroidery design is recreated from a pattern that is displayed on paper. However, when a computer is used to create an embroidery design, many factors must be considered in order to produce an accurate interpretation of the pattern. Factors such as color contrast, line thickness and general object recognition, which are easily identifiable by the human eye, are sometimes not easily interpreted by a computer.

Computer systems have been developed for generating embroidery designs. For example, U.S. Pat. No. 5,668,730 describes part of a computer aided design system that allows a pattern to be scanned into a computer. When patterns are scanned into the computer, the scanner creates a file which depicts the characteristics of the scanned image. Once the file is created, these systems require human manipulation of the image to identify and distinguish its certain characteristics. For example, the user provides the outline in the image. This method of generating embroidery designs is not fully automated, since human manipulation of the image is required to ensure its accuracy. As a result of the required human interaction, this method of generating designs is inefficient and cumbersome.

A particular embroidery pattern cannot ever conform to any particular characteristics. Each pattern contains unique characteristics such as size and color. Depending upon how complex the pattern is, the human interaction required to interpret the scanned image may be significant, which thereby hampers the efficiency of the system.

U.S. Pat. No. 5,740,056 describes a method and device for producing embroidery data that also uses embroidery data that has been scanned into a file. Once the file is read in, continuous line components in the file are extracted and these line components are processed to generate start and end points needed for stitching. This method is not as accurate since no smoothing of the image is performed before fine line components are extracted.

As the complexity of items that require embroidery increases, the need for better mechanisms for automatically generating embroidery designs from a pattern becomes more apparent. To the extent that a mechanism cannot efficiently and accurately interpret intricate scanned patterns into embroidery designs, the ability to automate embroidery stitching is impaired.

One aspect of this field relates to structural indexing, which is related to shape recognition and/or image understanding. In "Structural Indexing: Efficient 2-D Object Recognition" by F. Stein and G. Medioni, IEEE Transactions on Pattern Analysis and Machine Intelligence, 1992, the authors attempted to recognize complete complex shapes. These shapes were limited to those having a single external edge contour (i.e., no holes within the shape). Specifically, metrics were extracted from line-approximated representations of the single edge contour of the shapes. Then, those metrics were used to index the contours within a larger database of contour models.

The Stein and Medioni reference serves as a good introduction to the basic concepts of structural indexing, but differs substantially from the present invention. Some key differences from this prior art include the use of a structural index to identify specific types of singularities, rather than entire shapes and the use of new, more appropriate, extracted metrics for this problem.

Other work has been presented within the field of handwriting recognition. Specifically, the recovery of temporal stroke information and restoration of occluded boundaries from images of cursive handwriting has been the subject of many journal articles. However, these approaches are narrowly focused within the domain of handwriting recognition and do not utilize the structural indexing approach presented here.

The methods presented in the aforementioned parent patent application form a strong and comprehensive basis for automatically generating embroidery designs from scanned images. However, to more completely replace human expertise in the automation process and improve the quality of data generated, a system must encapsulate dynamic learning capabilities as its human counterpart would. Thus, one aspect of the present invention addresses this important issue. Specifically, the utilization of a structurally indexed singularity database, combined with a unique and intuitive user interface, allows the automation system to actually learn from its human counterparts. This is believed to be a non-existent capability of any such similar system. For purposes of the description herein, the terms "singular region" and "singularity" are considered interchangeable with each other, as are the terms "regular region" and "regularity" with each other.

SUMMARY OF THE INVENTION

In accordance with the present invention, a method and apparatus for manipulating singular regions for automatic embroidery data generation is provided. The preferred embodiment of the present invention includes a singularity processing mechanism that allows singular regions of thin, predominantly regular shapes to be processed robustly in an accurate and aesthetically pleasing manner for subsequent embroidery data generation.

The singularity processing mechanism (SPM) operates upon the data structures created within the embroidery data generating mechanism described in the parent patent application, Ser. No. 09/134,981. The SPM includes an evaluate singularity mechanism that closely resembles the original mechanism of the parent case.

The evaluate singularity mechanism is responsible for determining an initial ordered set of reasonable interpretations for a singular region, while accommodating constraints such as minimization of energy required for reconstruction of occluded boundaries. The first item in this ordered set is the interpretation that the system deems most preferable, the second item being the second most preferable etc. Thus, the first interpretation item (or default choice), in many cases, will closely correspond to the output of the mechanism of the parent case.

Additionally, the evaluate singularity mechanism will interact with records within the stored singularity interpretation data, which is structurally indexed, to determine whether any similar singularities were previously encountered and processed in a unique way (i.e., different from the default first interpretation item). If one or more record matches are found within the stored singularity interpretation data, the data from these records is merged into the generated ordered set of reasonable interpretations. This will most likely produce a new first interpretation item (or default choice) that is a result of the system learning from a previously encountered singular region processed by the SPM.

The output of the evaluate singularity mechanism is forwarded to the user adjustment mechanism within the SPM. The user adjustment mechanism displays the first interpretation item (or default choice) for the user to accept or adjust/edit. A user's acceptance of the default choice is implied when no adjustments are performed.

Several types of adjustments are possible and may be performed by the user via novel and efficient graphical user interface (GUI) elements. The first GUI element operates by displaying a small icon or shaded area within or around the singular region being processed, which may be clicked upon by the user. This GUI element may be considered as a control surface for allowing the user to make automated intelligent adjustments to the interpretation of the singularity. When activated, this element will cause an alternative interpretation of the singularity to be displayed, these alternatives having been defined within the ordered set of reasonable interpretations created previously by the evaluate singularity mechanism. Multiple activations will apply additional alternatives from this set of reasonable interpretations.

Other GUI elements operate by allowing the user to modify or replace the occluded boundaries generated automatically by the system. Modifications may include alterations of starting and ending points for sections of occluded boundaries, as well as the introduction of additional vertices or curvature that alter the shape of an occluded boundary.

If execution of the user adjustment mechanism indicates that, in fact, the user made one or more adjustments, the SPM executes the singularity storage mechanism. Otherwise, the SPM completes its execution and returns control back to the embroidery data generating mechanism described heretofore.

If the singularity storage mechanism is executed (again, indicating that adjustments were made), a set of operations ensue that effectively store the composition and nature of the singularity and any specific modifications made to its interpretation, within a structurally indexed non-volatile data store. Thus, this mechanism facilitates a feedback process that allows the system to learn from the user, since this data store will be utilized by the evaluate singularity mechanism for subsequent invocations of the SPM.

BRIEF DESCRIPTION OF THE DRAWINGS

The preferred exemplary embodiments of the present invention will hereinafter be described in conjunction with the appended drawings, where like designations denote like elements, and.

DESCRIPTION OF THE PREFERRED EMBODIMENT

The invention provides a singularity processing mechanism (SPM) that allows singular regions of thin, predominantly regular shapes to be processed robustly in an accurate and aesthetically pleasing manner for subsequent embroidery data generation. The method and apparatus of the present invention apply to any computer system (such as those described in copending U.S. patent application, Ser. No. 09/134,981, hereby incorporated by reference) that includes a processor, a main memory, a memory controller, an auxiliary storage interface, and a terminal interface, all of which are interconnected via a system bus.

The preferred embodiment of the present invention requires labeled skeletal and edge contour representations of a shape as input. This labeling includes indications of characteristic edge points corresponding to associated skeletal nodes that specify the presence of singular regions within the shape. Additionally, some type of distance transform information is stored, corresponding to the shape. Either the mechanisms described within the parent patent application or some similarly equivalent mechanisms should be employed to provide such input.

Figure 1A:
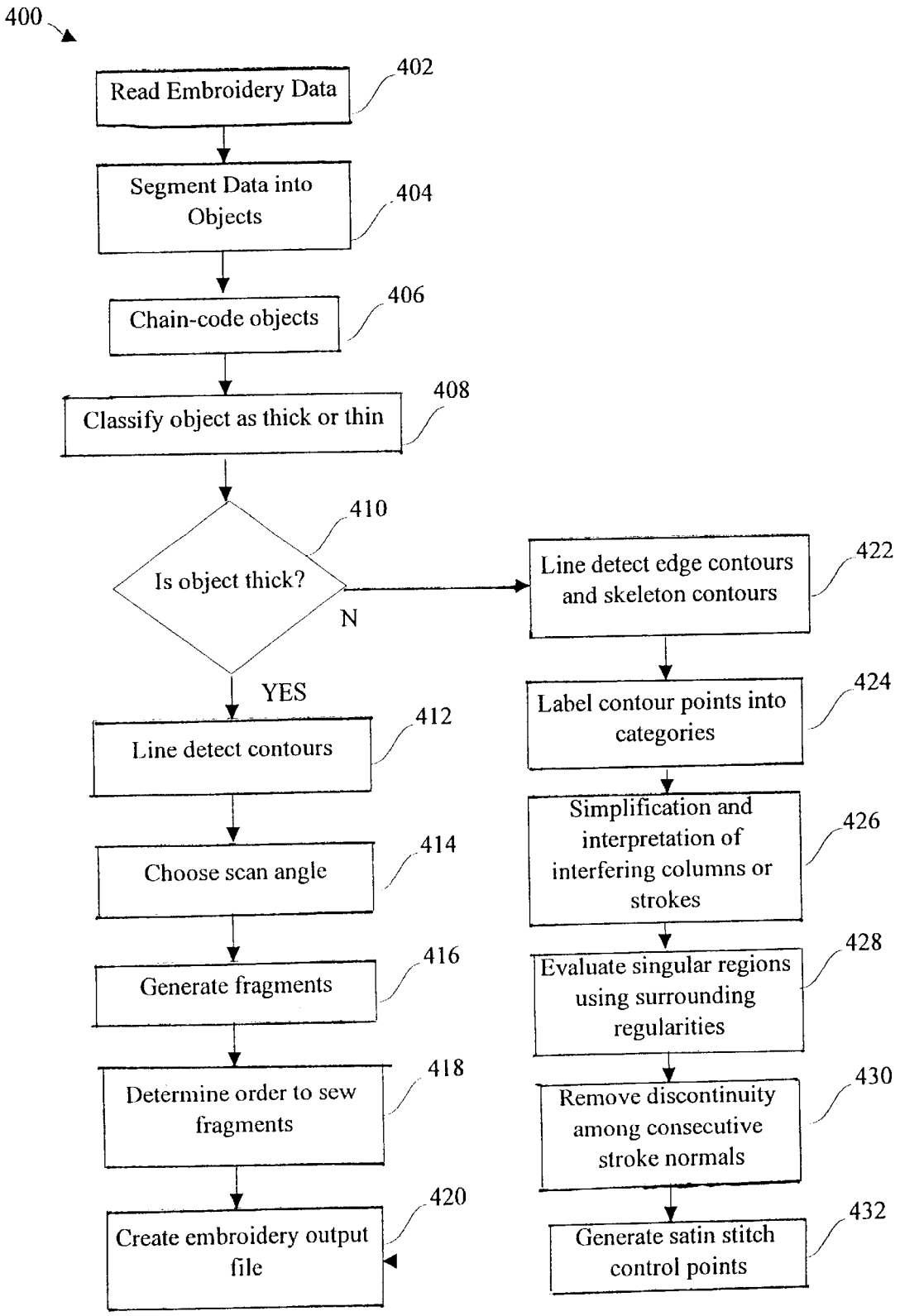
FIG. 1*a* is a flow chart illustrating a method for automatically generating an embroidery design from a scanned embroidery pattern in accordance with a preferred embodiment of the present invention.

Now referring to FIG. 1*a,* a method 400 for automatically generating an embroidery design from a scanned embroidery pattern is shown. Method 400 begins in step 402 when the embroidery generating mechanism reads embroidery data that has been input into a data file using a scanner.

A scanner, not shown, generates a bitmapped file representation of the scanned pattern. The embroidery generating mechanism smoothes the bitmapped image to minimize the amount of noise generated during the scan.

In step 404, the embroidery generating mechanism executes the segmentation mechanism. The segmentation mechanism segments contiguous regions of similar color into objects, each object having a unique object identification. Any pixels that have not been segmented into objects are usually found around areas of high contrast or noise in the image. Each uncategorized pixel is absorbed into an object which neighbors the uncategorized pixel. The segmentation mechanism compares the closeness of an uncategorized pixel as well as the color similarity of the uncategorized pixel to determine the neighboring object to which the uncategorized pixel should be merged.

Once all pixels in the bitmap have been categorized into objects by the segmentation mechanism, the segmentation mechanism removes any objects containing less than six pixels, since it is assumed that these objects represent mere noise. The segmentation mechanism then assigns the pixels belonging to these noise regions with the object identification of the nearest largest neighboring object.

In step 406, the embroidery generating mechanism executes the chain-code mechanism. Once the chain-code mechanism executes, the embroidery generating mechanism executes the thinning mechanism, step 408. The thinning mechanism classifies each object in the embroidery data as being either a thin object or a thick object. As explained above, a thin object is stitched in columns using satin stitching whereas a thick object is stitched in rows using fill stitch.

The thinning mechanism is able to classify each object since all thin objects are characteristically made up of regular regions. Regular regions display properties of constant thickness with few areas where multiple regions intersect. The thinning mechanism detects regular objects by examining the distance transform values of pixels in the skeleton of the object. As mentioned above, each thin has an outer edge (i.e., simply the outer edge of an object), zero or more inner edges and a skeleton which is centered between edges.

These skeletal pixels typically contain distance transform values that fall within a relatively narrow range. In effect, as each pixel in the object skeleton is examined, no significant variation (increase or decrease) should exist of the associated skeletal pixels' labeled distance transform values. A lack of such deviation signifies that the region represented by the skeleton is of a relatively uniform thickness and direction. For this reason, the average distance transform value, combined with the standard deviation, is used as an initial classifier for objects within the embroidery data. In other words, for each object, an average thickness is computed which is the average of all distance transform values within the object's skeleton.

Afterwards, the standard deviation from this thickness may be computed. If the standard deviation is sufficiently low and the average thickness is below a specified threshold, the region may be classified as predominantly regular and marked to be interpreted as a set of stroke-like regions. All other regions are considered to be blob-like or irregular in nature and are marked as fill regions. The classification of a thick object requires significantly different processing than does a thin object.

Once the thinning mechanism classifies an object as thick or thin, step 408, the embroidery generating mechanism determines whether an object has been classified as thick, step 410. If an object has been classified as thick, step 410, the embroidery generating mechanism executes the line fitting mechanism, step 412. The line fitting mechanism detects the external edge contours and internal edge contours.

The embroidery generating mechanism executes the stitch-angle determination mechanism, step 414. The stitch-angle determination mechanism chooses a scan angle from sixteen possible scan angles that generates the fewest fragments for the object.

Once the stitch angle determination mechanism chooses an angle that minimizes fragmentation, the embroidery generating mechanism executes the fragment generation mechanism, step 416. Once a minimum set of fragments is generated for a fills stitch object, an optimal ordering of the fragments must be derived. Specifically, the fragments should be sewn in a particular order as to both minimize thread cuts and run stitching while maintaining path connectivity as much as possible. Once fragments are generated, step 416, the embroidery generating mechanism executes the generate path mechanism, step 418, to determine the most optimal order for sewing the fragments.

The entry and exit points into the region (i.e., where sewing begins and ends) can be any points on an exterior contour belonging to the region. Then, the fragments that are touched at these points may be determined easily. The fragment corresponding to the region exit point is examined first. Here, a recursive procedure is defined which traverses the remaining fill fragment regions starting from this ending region. As recursive calls are completed, mark points for fill fragments are generated until finally, the ending region's mark points are generated. The order in which fragments are traversed is dependent on several factors. Ideally, after a single fragment is traversed or sewn, running stitches should be generated within the interior of the global region to the entry point of the next fragment to be traversed or sewn.

It is preferable to use running stitches instead of individual thread cuts and needle up movements between fragments since the associated overhead is significantly less. The running stitches generated between fragments must eventually be covered up when the fragments fill stitching is sewn. The desire to eliminate thread cuts implies that, while sewing a fill region, the needle is always down (i.e., leaving a trail of stitching behind it). Thus, the planning of fill fragments and running stitches sewn between them is quite important.

Additionally, it may occur that such an ordering is impossible with the given minimum set of fragments provided. (That is, the algorithm is forced to sew itself into a corner so to speak.) To avoid this, either a thread cut may be introduced and needle up movements may be performed to gain access to remaining un-sewn portions of the object, or a further fragmentation of the original fragments may be performed. This additional fragmentation allows the sequence of traversed fragments to continue at the cost of increasing the total number of fragments or sub-regions that must be sewn. This cost could be significant if shifts or buckles in the material being sewn occur due to the excessive movement between multiple fragments.

Once the generate path mechanism finishes executing, step 420, the embroidery generating mechanism executes the embroidery output mechanism.

If the object was not classified as a thick object, step 410, the object is a thin object to be sewn with satin stitch. When an object is classified as a thin object by the thinning mechanism, step 408, the embroidery generating mechanism executes the line fitting mechanism, step 422. Like the line fitting mechanism performed in step 412, the line fitting mechanism of step 422 performs line fitting on the external and internal contours of the thin object. However, the line fitting mechanism additionally represents the skeletal branches and notes in data structures, step 422.

Once the line fitting mechanism executes, step 424, the embroidery generating mechanism executes the labeling mechanism. The labeling mechanism identifies and classifies the outer contour, the inner contour(s), and the skeleton contour within various categories.

Once the labelling mechanism finishes executing, the embroidery generating mechanism executes the merging mechanism, step 426. After the skeleton and contours are labeled and correlated, further simplification and interpretation may be performed. In addition to the removal of bifurcation and elongation artifacts, sets of hard coded procedures are used to check for other special cases occurring within the representation extracted thus far.

The coding mechanism executes to evaluate singular regions using surrounding regularities, step 428, described in greater detail hereinbelow. The remaining singular regions located around skeletal junction nodes are indicative of a set of interfering regular regions. These regular regions merge at the associated singularity causing any continuity between the set of regularities to be occluded. Processing described here attempts to reconstruct the occluded stroke or contour information by utilizing a simple energy minimization strategy.

Once the coding mechanism executes, the embroidery generating mechanism executes the column smoothing mechanism, in step 430. The column smoothing mechanism customizes the region description to embroidery data point generation. This step is a smoothing operation in that it attempts to remove discontinuity among consecutive stroke normals, making the transition from one stroke normal to the next more "smooth."

When the column smoothing mechanism is finished executing, the embroidery generating mechanism executes the path generation mechanism, step 432. The path generation mechanism generates satin stitch embroidery control points that correspond to the end points of each stroke normal.

Once path generation mechanism generates the control points, the embroidery generating mechanism executes the embroidery output mechanism, step 420. It should be understood that all objects within the embroidery data are processed until mark points for each object are generated. Once the embroidery output file is generated, any sewing device can use the information contained within the file to stitch the embroidery design.

Figure 1B:
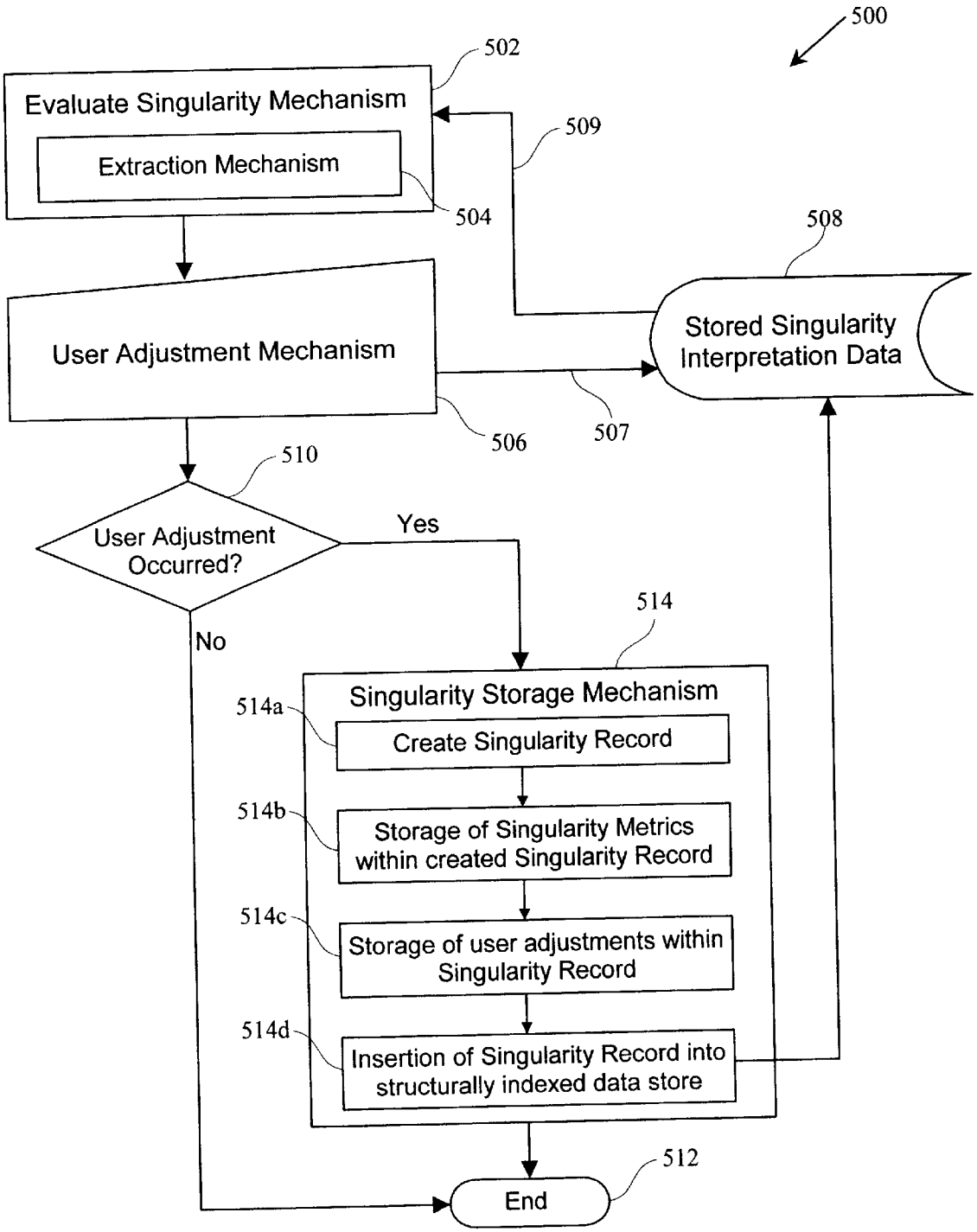
FIG. 1*b* is a flow chart depicting the singularity processing mechanism (SPM), which processes singularity information in accordance with a preferred embodiment of the present invention.

Referring now to FIG. 1*b,* a flow chart is shown to describe the evaluation of singular regions, step 428 (FIG. 1*a*), in greater detail. A singularity processing mechanism (SPM) is depicted and shown generally at reference numeral 500. The processing of singularity information is performed in accordance with a preferred embodiment of the present invention. Generally, for each singularity detected, the necessary input as it relates to the particular singularity, as described previously, is supplied to a singularity processing mechanism.

In turn, the SPM executes a series of sub-mechanisms on the supplied input and produces a final interpretation of the particular singularity. This final interpretation specifies any correlations between regular regions joined at the singularity and reconstructs any associated occluded boundaries. This final interpretation is subsequently applied to additional embroidery data generating mechanisms, not shown, to ultimately generate embroidery data that, when fed to a sewing device, can recreate embroidery corresponding to the original regions and the singularities that were contained within those regions.

SPM 500 contains: an evaluate singularity mechanism 502, including an extraction mechanism 504; a user adjustment mechanism 506; a singularity storage mechanism 514; and stored singularity interpretation data 508.

Figure 2A:
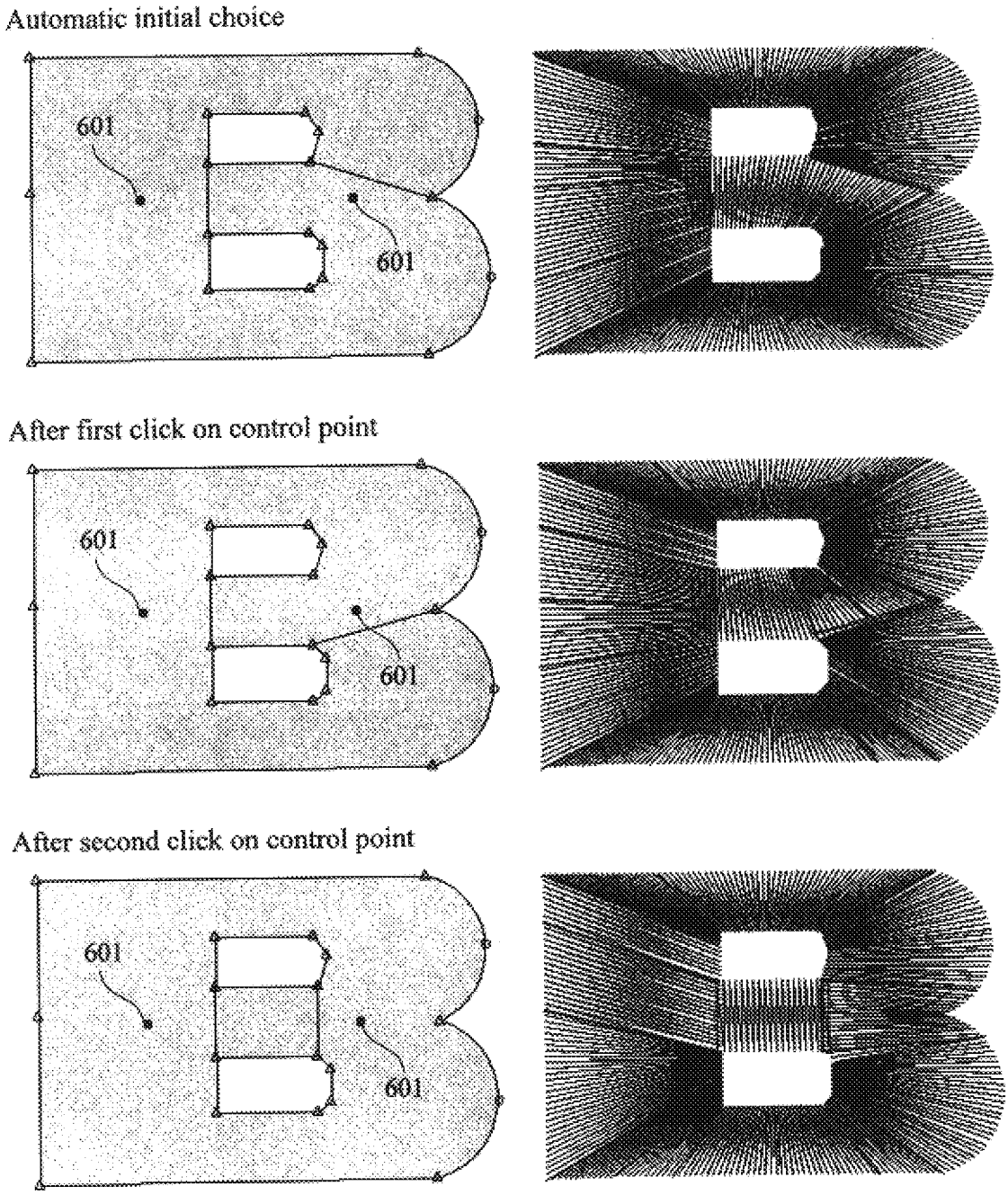
FIG. 2*a* shows three possible interpretations of a letter B.

Referring to FIG. 2*a,* one of two singular regions is shown interpreted in three different ways with appropriate occluded boundaries reconstructed for each way. Simulated stitching generated for those three interpretations is shown on the right. Also summarized is an efficient user-interface specification to move from one interpretation to the next.

Three possible interpretations of a letter B are depicted. Before the SPM executes, no correlations between regular regions joined at a singularity exist and no occluded boundaries are reconstructed. Processing of the letter B indicates that two singular regions are detected within the shape of the letter B. Each detected singular region is indicated by the placement of a small dot at or around its location. However, the connections between regular regions joined at those singular regions (as illustrated by the simulated stitch output on the right side) do not exist before the SPM executes. The boundaries that further divide the shape at singular locations (i.e., occluded boundaries) also do not exist prior to execution of the SPM.

Thus, after the necessary input is supplied, the SPM executes evaluate singularity mechanism 502. The evaluate singularity mechanism 502 is responsible for determining an initial ordered set of reasonable interpretations for a singular region where an interpretation includes correlating zero or more regular regions joined at a singularity with zero or more other regular regions joined at the same singularity. Additionally, an interpretation specifies any occluded boundaries desired for support of such correlations. These interpretations must accommodate constraints such as minimization of energy required for reconstruction of occluded boundaries.

The first item in this ordered set of interpretations is the interpretation that the system deems most preferable, the second item being the second most preferable, etc. How preferable an interpretation is deemed is based upon the degree to which it satisfies specified constraints. Thus, initially, the first interpretation item (or automatic default choice), in many cases, will closely correspond to the output of the corresponding mechanism described in the parent patent application.

More specifically, an initial set of interpretation items is computed by formulating all possible pairings of regular regions joined at the singular region and with each unique pairing being classified as an interpretation item. For each interpretation item, occluded boundaries are reconstructed to accommodate specified constraints as best as possible. Then, the interpretation items are ordered based upon the degree to which they have satisfied specified constraints.

Referring still to FIG. 2*a,* the first interpretation depicted was ordered first since an occluded boundary was constructed (and associated regular regions paired) that resulted in minimal energy loss. In effect, the transition through the singular region from one regular region to the other was calculated as smooth, having no sharp discontinuities.

Additionally, evaluate singularity mechanism 502 will eventually interact with records contained within the stored singularity interpretation data 508, which is structurally indexed, to see if any similar singularities were previously encountered and processed in a unique way (i.e., different from the default first interpretation item). If one or more record matches are found within the stored singularity interpretation data, the data from these records is merged, line 509, into the generated ordered set of reasonable interpretations. This will most likely produce a new first interpretation item (or default choice) that is a result of the system learning from a previously encountered singular region processed by the SPM.

Figure 3A:
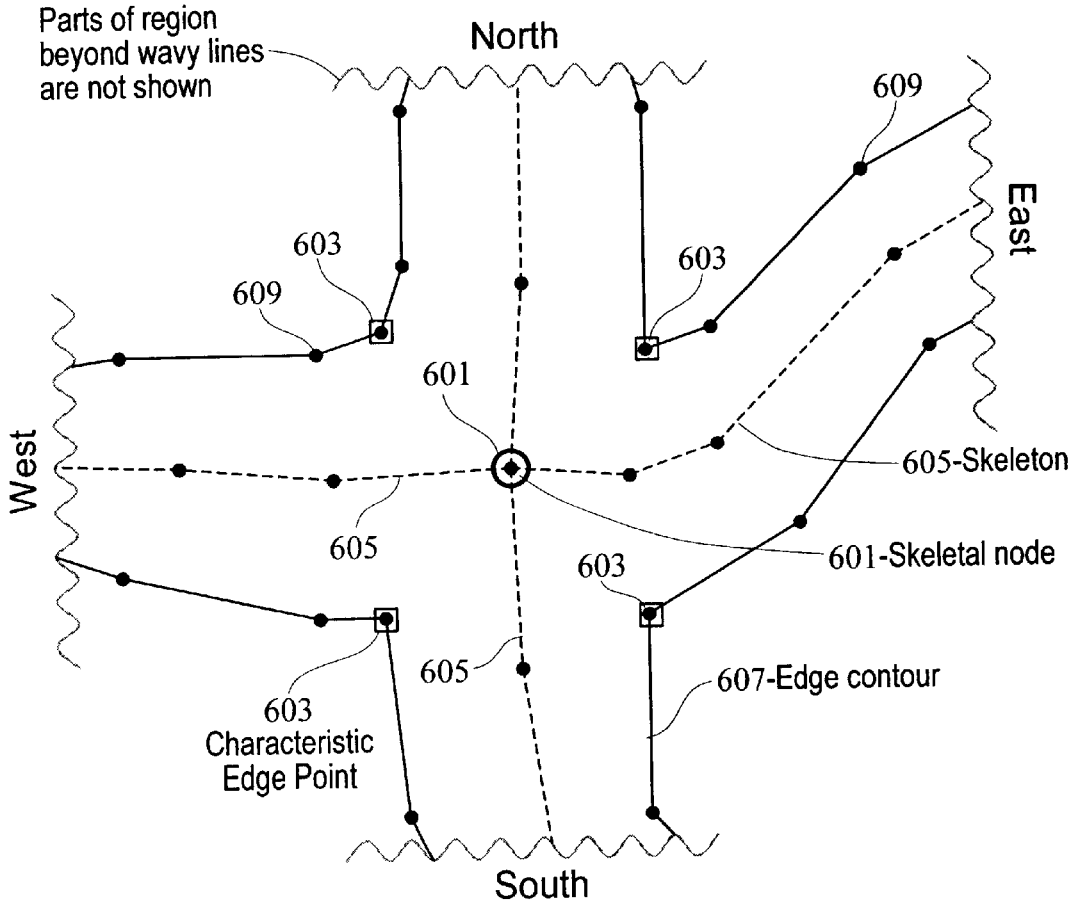
FIGS. 3*a*–3*e* show five versions of a singularity surrounded by four regularities.
Figure 3C:
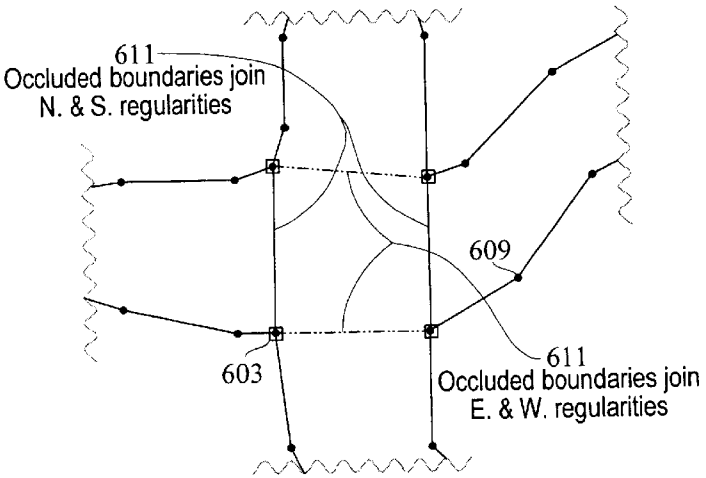
Figure 3E:
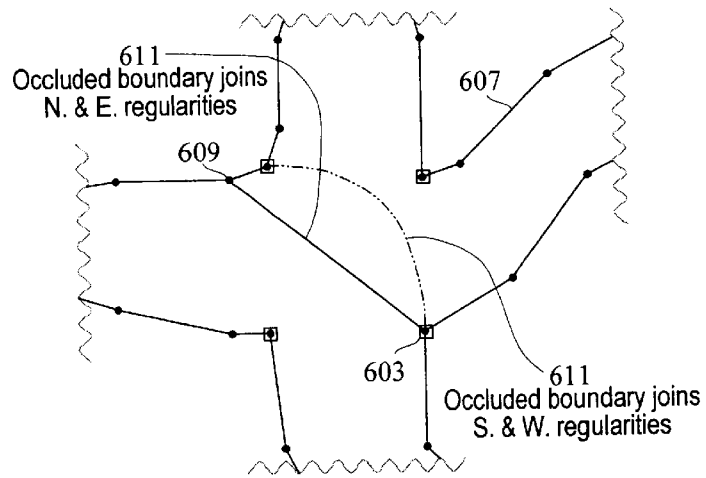
Figure 3B:
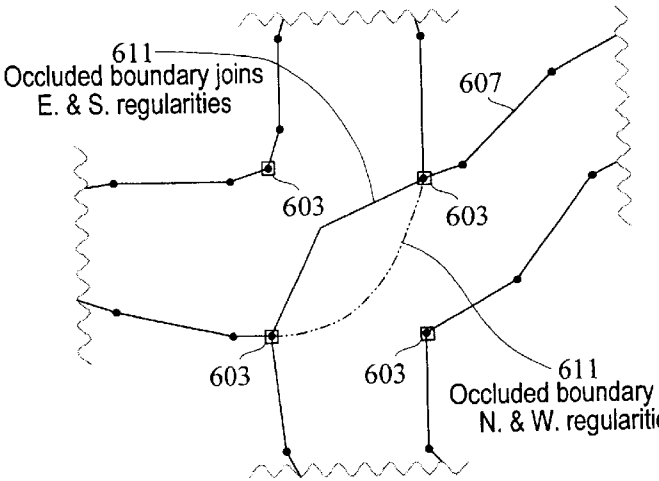
Figure 3D:
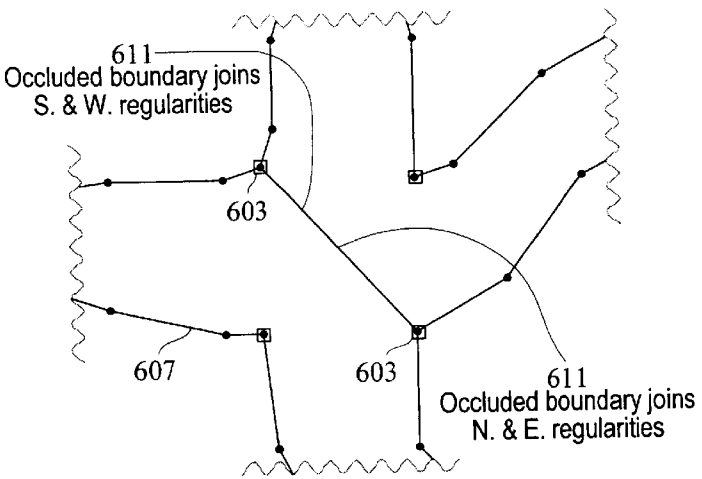

Referring to FIGS. 3*a*–3*e,* five versions of an example of a singular region surrounded by four regular regions are depicted. FIG. 3*a* depicts the associated skeleton and contours with characteristic edge points (or junction anchors) labeled. A small circle 601 within the center of the singular region, corresponding to a skeletal node, indicates a possible location for a graphical user interface control surface. FIGS. 3*b*–3*e* depict four possible interpretations (from an infinite set) of the singular region with occluded boundaries restored. FIG. 3*a* depicts the associated skeleton 605 (in phantom lines) and edge contours 607 with edge contour vertices 609. Specifically, small boxes 603 have been placed around edge contour vertices 609 that have been determined to be characteristic edge points (or junction anchors). The skeletal node 601 indicates the presence of the singular region and also a possible location for a graphical user interface control surface. FIGS. 3*b*–3*e* depict four possible interpretations (from an infinite set) of the singular region with occluded boundaries 611 having been restored. These drawings are also indicative of the information contained within the ordered set of interpretations generated by evaluate singularity mechanism 502 (FIG. 1*b*).

Prior to interaction with the stored singularity interpretation data 508, the evaluate singularity mechanism 502 executes extraction mechanism 504 which is a sub-mechanism of evaluate singularity mechanism 502. Extraction mechanism 504 extracts one or more metrics (or attributes) from the given singularity input. Metrics extracted here include structural features or general properties of the singularity. The extracted metrics serve to aggregate and summarize the details of the singular region in a flexible way. Several examples of such metrics will be discussed below.

Figure 4:
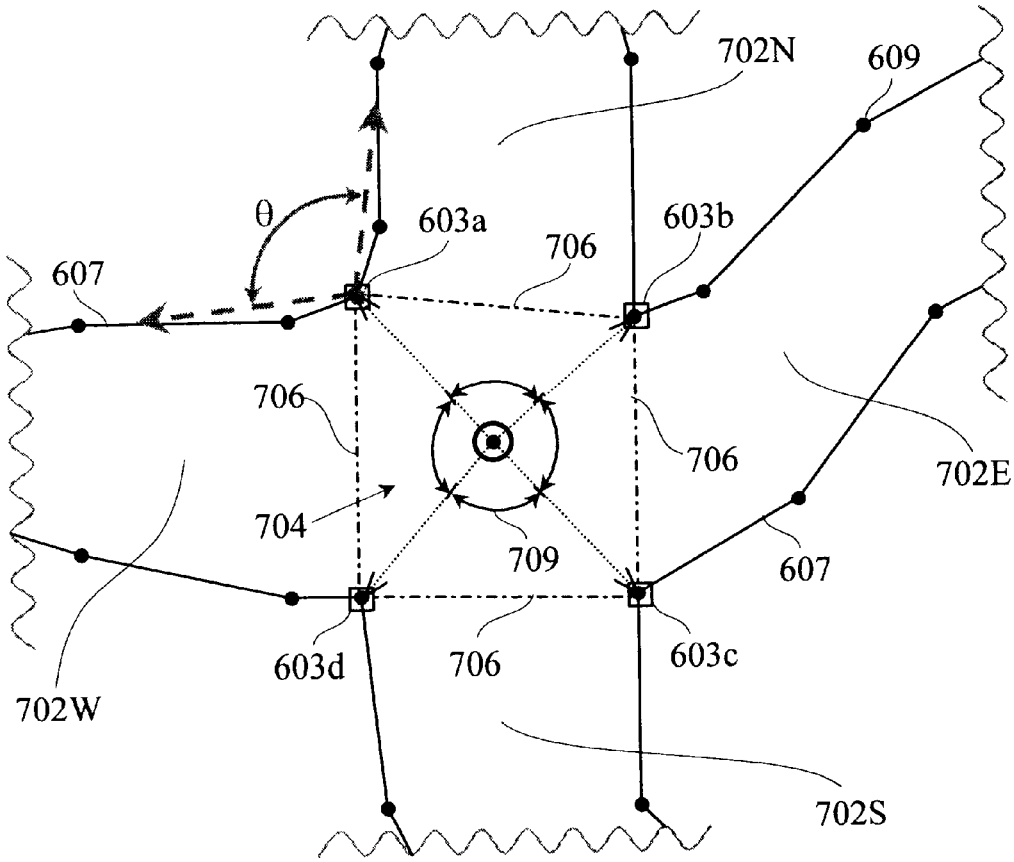
FIG. 4 is an example of a singular region with various extracted metrics (or attributes) illustrated.

Referring to FIG. 4, an example is shown of a singular region with various extracted metrics or attributes. First, four regular regions 702N, 702S, 702E, 702W are joined at the singularity 704. This number of regions 702N–702W also corresponds to the number of skeletal branches and the number of characteristic edge points 603*a*, 603*b*, 603*c*, 603*d* detected. Thus, the number of characteristic edge points serves as a useful first metric that further specifies the type of singularity encountered. Other metrics may be extracted by formulating directional vectors from the skeletal node 601, indicating the presence of the singularity, to the associated characteristic edge points 603*a*, 603*b*, 603*c*, 603*d*. Listing such metrics in a consistent order (e.g., clockwise or counterclockwise) provides another useful metric that specifies the properties of the singular region 704.

The angular difference 709 can be computed between successive directional vectors and the minimum and maximum differences can be extracted. These min/max metrics can be useful when comparing two singular regions that have different orientations. For example, one may be effectively rotated by a certain number of degrees when compared to the other. Aligning the minimum and/or maximum angular differences may facilitate the location of an orientation vector that may be used to normalize the values of other metrics. This orientation vector may itself be recorded as another useful extracted metric of the singularity.

The characteristic edge points 603*a*, 603*b*, 603*c*, 603*d* of a singular region 704 may be connected via line segments 706 forming a polygonal, characteristic edge point (CEP) shape. The properties of this CEP shape, including the angles contained within, its eccentricity (i.e., second moment of inertia), and any other aggregate properties create another set of useful metrics characterizing the singular region 704.

For each characteristic edge point (603*a*, for example), the edge contour 607 extending from that point 603*a* in both clockwise and counterclockwise directions can be examined allowing additional metrics to be extracted. For example, referring to FIG. 4, angle θ indicates an aggregate angle of concavity present at characteristic edge point 603*a*. Again, these metrics may be organized and/or categorized using various topological or statistical measures (e.g., clockwise/counterclockwise min/max/average/standard deviation/etc.).

Information about the thickness of a singular region 704 is another useful metric that may be obtained by examining previously computed distance transform data. This information may be used as a stand alone metric and/or as a factor used to normalize other extracted metrics. For example, the total distance along an edge contour 607 to traverse when computing aggregate angles of concavity may be set proportionally to the "thickness" of the singularity 704 (average width of the shape around the singularity).

Once a given set of structural metrics are extracted, stored singularity interpretation data 508, which is indexed using those metrics, may be queried. For example, all stored singularity interpretations that have a particular number of characteristic edge points and whose CEP shape's eccentricity lies within a particular range may be quickly retrieved. The results of this retrieval may then be queried further, if necessary, using other extracted metrics. The point of such queries is to effectively reduce the number of potentially similar singularities that must be compared more closely with the current singularity.

If no similar singular regions are located within stored singularity interpretation data 508, no alteration is performed to the maintained ordered set of singularity interpretations.

However, if records for one or more sufficiently similar singularities are located within stored singularity interpretation data 508, these records are effectively merged, line 509 (FIG. 1*b*) into the ordered set of singularity interpretations currently maintained. Specifically, in the case of matches, each record will become a new interpretation in the ordered set, and interpretation adjustments indicated in the singularity interpretation record are effectively mapped onto the singular region currently being evaluated. This mapping should typically be obvious since the singularities are sufficiently similar to one another. The position of these newly inserted interpretations (e.g., first, last, or intermediate) is based on two criteria:

1) the degree of similarity between the singular region currently being evaluated and the singular region stored in the singularity interpretation record retrieved; more similar matches (i.e., less deviation between extracted metrics) are placed closer to the beginning of the ordered set; and 2) in the less likely event that multiple near exact matches exist between the singular region currently being evaluated and multiple singularity interpretation records, a number stored with the singularity interpretation record is examined that indicates the number of times that this interpretation has been actually applied to singularities evaluated during previous invocations of the SPM; specifically, more commonly applied records (i.e., with higher numbers) are placed closer to the beginning of the ordered set. If after utilizing all criteria, there still remain singularity records that for all practical purposes are identical in terms of the singular regions they represent, their ordering within the set will be arbitrary.

It may also be possible to easily add additional criteria for merging retrieved singularity records into the ordered set of singularity interpretations. These include incorporating more information about the context in which singularities appear. Specifically, information can be extracted and recorded about the nature of connected regularities and additional singular regions that may be reached when those regularities are traversed.

The last step in evaluate singularity mechanism 502 processes the merged ordered set of singularity interpretations to eliminate redundancy. Specifically, it may occur that two or more interpretations within that set are sufficiently similar. In this case, only the first occurrence of the interpretation is retained while the other sufficiently similar interpretations are eliminated from the ordered set. Here, similarity is measured if the mapping of regularities (to one another) joined at the singularity is identical and the reconstructed occluded boundaries do not deviate from one another at any point by more than a predefined threshold.

The output of evaluate singularity mechanism 502, which is equivalent to the ordered set of singularity interpretations, is provided to user adjustment mechanism 506 within the SPM 500. The user adjustment mechanism displays the first interpretation item in the ordered set, which may be referred to as the default choice, for the user to accept or adjust/edit. A user's acceptance of the default choice is implied when no adjustments are performed. There are several types of adjustments possible that may be performed by the user via novel and efficient GUI elements.

The display of a particular interpretation item, whether it is edited or not, is equivalent to depicting the singularity, surrounded by its associated edge contours, with any mapping of regular regions and the nature of any occluded boundaries clearly indicated. FIG. 2 illustrates how three possible interpretation items might be depicted.

The first GUI element operates by displaying a small icon or shaded area, within or around the singular region being processed, which may be clicked upon by the user. This GUI element may be considered as a control surface for allowing the user to make automated intelligent adjustments to the interpretation of the singularity. When activated, this element will cause the next alternative interpretation of the singularity to be displayed, these alternatives having been defined within the ordered set of singularity interpretations created previously by evaluate singularity mechanism 502. Multiple activations will apply additional alternatives from this set.

An activation of the control surface may be initiated in a number of ways including the simple act of merely clicking on it with the mouse cursor. This type of activation is referred to as a single click next best choice interface. FIG. 2*a* depicts an example of this interface by showing the initial interpretation of the letter B and then showing the resultant versions after successive clicks of the control surface representing the singularity on the right side of the letter.

Additional methods of activating the control surface in this GUI element may also be devised. The main motives of which would be to allow the user to quickly and easily apply different interpretations to a singular region within a shape. For example, it is also feasible that upon clicking on the control surface, a drop down menu is displayed that provides smaller graphical previews of possible interpretations next to a series of menu items. The user would then be allowed to pick an interpretation directly by clicking on the corresponding menu item.

Other GUI elements operate by allowing the user to modify or replace the occluded boundaries generated automatically by the system. Modifications may include alterations of starting and ending points for sections of occluded boundaries as well as the introduction of additional vertices or curvature that alter the shape of an occluded boundary. Via these other GUI elements the user is also able to change the mappings between one or more regularities joined at a singular region.

Figure 2B:
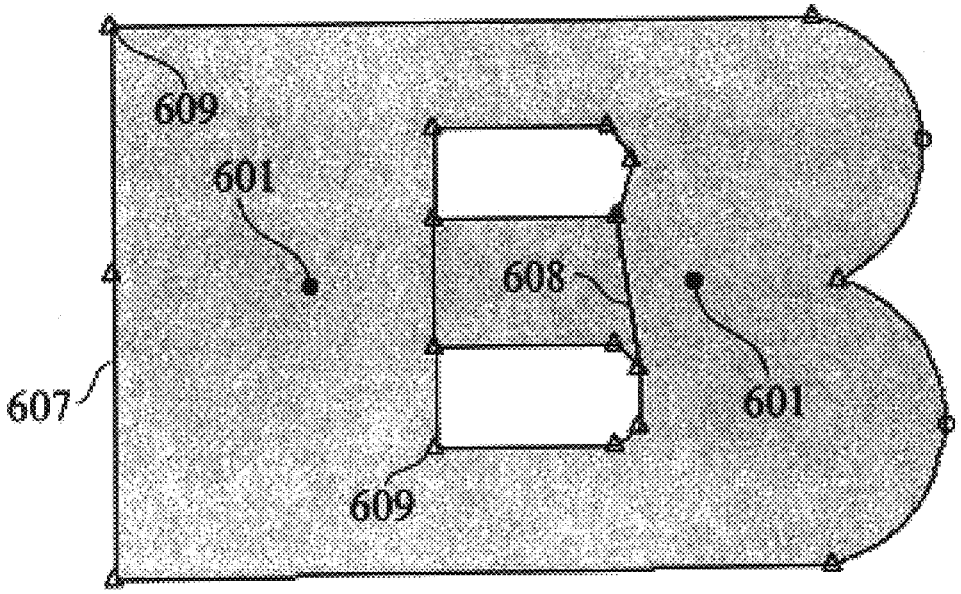
FIG. 2*b* shows an allowed versus a disallowed edit of the letter B.
Figure 2B:
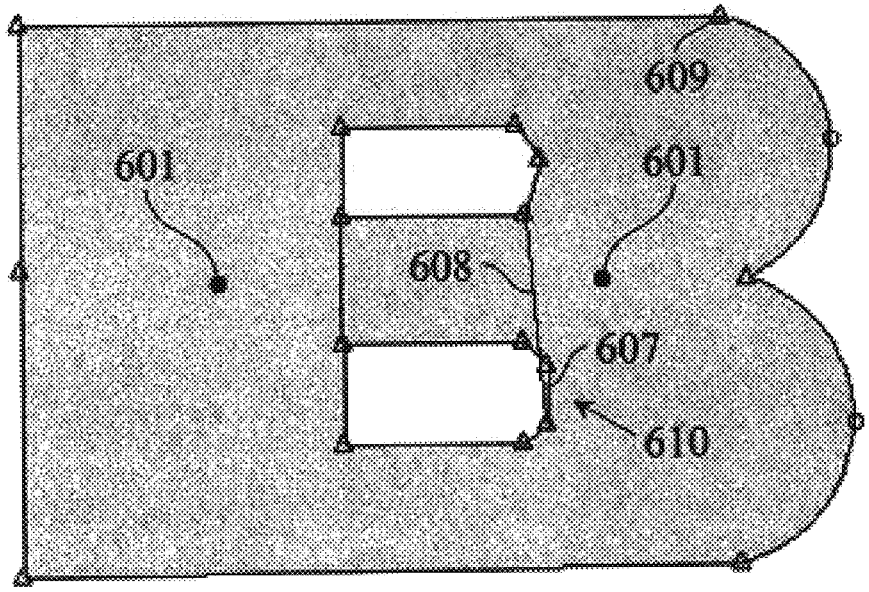

Referring now to FIG. 2*b,* the changes a user makes to the interpretation of a singular region are also validated by the system before those changes actually are displayed to the user or applied to the singularity. It should be understood that any number of constraints may be formulated or devised to validate or invalidate editing of the interpretation of a singularity and still be within the scope of the invention. The real-time application of such constraints (including, but not limited to, continuity of edge contour or thickness, angular directions, irregularity, or occluded boundary protrusion) helps guide the user to easily choose appropriate interpretations. For example, when the user alters the starting location for an occluded boundary the point may be dragged via the mouse while depressing a mouse button. As the point is dragged, a rubber-band line or curve 608 is drawn indicating the location of the newly adjusted occluded boundary. However, an adjustment that results in the occluded boundary extending beyond the area delimited by the edge contours (of the shape containing the singular region), shown generally at reference numeral 610, must be deemed invalid since the resultant interpretation would produce a distinctly different and inaccurate version of the shape. Thus, in this case rubber-banding is halted at the last valid point dragged to by the user. Rubber-banding resumes only when the mouse cursor is moved to a location that prevents such invalidity from occurring. This type of immediate validation of user input provides a more efficient user interface while ensuring accurate processing of singularities. FIG. 2*b* shows one example of a valid/allowed edit (upper portion of figure) versus an invalid/disallowed edit (lower portion of figure).

When user adjustment mechanism 506 displays a particular interpretation item that corresponds exactly to a retrieved record from stored singularity interpretation data 508, the record is updated within that stored data to indicate that the record has been applied. Specifically, a number stored with the singularity interpretation record is incremented to indicate a new application of that record has occurred. If the singularity's interpretation is changed (i.e., the record is no longer applied), via one of the GUI elements disclosed previously, the number stored in the record is decremented. Recall that this additional information is maintained and updated for use by evaluate singularity mechanism 502 as described previously. This interaction between user adjustment mechanism 506 and stored singularity interpretation data 508 is depicted in FIG. 1*b* by the arrow 507 located between those two items.

Referring back to FIG. 1*b,* if execution of the user adjustment mechanism indicates that, in fact, the user made one or more adjustments, SPM 500 executes singularity storage mechanism 514. Otherwise, the SPM 500 completes its execution and returns control back to the previously disclosed embroidery data generating mechanism.

If singularity storage mechanism 514 is executed (again, indicating that adjustments were made), a set of operations ensue that effectively store the composition and nature of the singularity and any specific modifications made to its interpretation, within a structurally indexed non-volatile data store. Thus, this storage mechanism 514 facilitates a feedback process that allows the system to learn from the user since this data store is utilized by the evaluate singularity mechanism 502 for subsequent invocations of the SPM 500.

Processing performed within singularity storage mechanism 514 begins with the creation of a singularity record 514*a* that specifies the edge contours surrounding the singularity. Only a section of the edge contour present around each characteristic edge point need be stored. The size of the section of contour stored may be proportional to the singularity's extracted thickness or some other appropriately chosen metric. It is also useful to normalize the vertex locations (i.e., x,y coordinates) via another extracted metric such as the averaged location of characteristic edge points that surround the singular region.

Additionally, chosen singularity metrics, as described above should be stored with the singularity record, 514*b*. Finally, any user adjustments made to the interpretation of the singularities should be stored within the singularity record, 514*c*, in a consistent manner (e.g., normalized using the same metrics used to normalize other stored information about the singularity).

After all data has been stored within the singularity record it is then inserted, via 514*d*, into stored singularity interpretation data 508, which is structurally indexed based on the chosen extracted and stored singularity metrics. The method of indexing is not relevant to this particular invention in that any suitably efficient method may be chosen. For example, methods such as binary search, B-trees, $B^+$-trees, or hashing may all be suitable indexing methods in that their worst-case time complexity is relatively low when locating records based on index key values.

Since other modifications and changes varied to fit particular operating requirements and environments will be apparent to those skilled in the art, this invention is not considered limited to the example chosen for purposes of this disclosure, and covers all changes and modifications which do not constitute departures from the true spirit and scope of this invention.

Having thus described the invention, what is desired to be protected by Letters Patent is presented in the subsequently appended claims.

What is claimed is:

1. In a method for processing an image consisting of at least one contiguous region or shape defined by at least one edge contour, said shape comprising at least one singularity or singular region where regular regions, comprising areas of substantially constant thickness, interfere with each other, said method for interfacing between a user and embroidery automation software, said method comprising the steps of:

a) detecting at least one singularity within a predetermined shape and from said shape itself, which singularity is an area within predominantly regular contiguous objects;

b) applying a singularity processing mechanism (SPM) to generate ab initio at least one embroidery interpretation representative of said at least one singularity; and c) modifying said at least one interpretation to generate a more aesthetically pleasing effect within said predetermined shape.

2. The method for interfacing between a user and embroidery automation software in accordance with claim 1, wherein said applying an SPM step (b) comprises real-time validation of user modifications to said at least one interpretation.

3. The method for interfacing between a user and embroidery automation software in accordance with claim 2, the steps further comprising:

c) suppressing invalid interpretations.

4. The method for interfacing between a user and embroidery automation software in accordance with claim 1, wherein said applying an SPM step (b) permits efficient modification of said at least one interpretation via a graphical user interface (GUI) by a user.

5. The method for interfacing between a user and embroidery automation software in accordance with claim 4, wherein said efficient modification comprises one of the group of single-click, menu drop, dialogue box, touch screen and voice activated, next best choice procedure.

6. The method for interfacing between a user and embroidery automation software in accordance with claim 4, wherein said method for interfacing comprises a learning system utilizing stored information relating to singularities in the form of a knowledge base.

7. In a method for processing an image consisting of at least one contiguous region or shape defined by at least one edge contour, said shape comprising at least one singularity or singular region where regular regions, comprising areas of substantially constant thickness, interfere with each other, said method for interfacing between a user and embroidery automation software, said method comprising the steps of:

a) detecting at least one singularity within a predetermined shape and from said shape itself, which singularity is an area within predominantly regular contiguous objects; and b) modifying at least one embroidery interpretation representative of, and relating to said at least one singularity to generate a more aesthetically pleasing effect within a final generated embroidery.

8. The method for interfacing between a user and embroidery automation software in accordance with claim 7, the steps further comprising:

c) validating user modifications to said at least one interpretation.

9. The method for interfacing between a user and embroidery automation software in accordance with claim 8, the steps further comprising:

d) suppressing invalid interpretations.

10. The method for interfacing between a user and embroidery automation software in accordance with claim 7, wherein said modifying said at least one interpretation step (b) is performed efficiently via a graphical user interface (GUI) by a user.

11. The method for interfacing between a user and embroidery automation software in accordance with claim 10, wherein said efficiently modifying said at least one interpretation comprises using one of the group of single-click, menu drop, dialogue box, touch screen and voice activated, next best choice procedure.

12. The method for interfacing between a user and embroidery automation software in accordance with claim 10, wherein said method for interfacing comprises a learning system utilizing stored information relating to singularities in the form of a knowledge base.

13. In a system for processing an image consisting of at least one contiguous region or shape defined by at least one edge contour, said shape comprising at least one singularity or singular region where regular regions, comprising areas of substantially constant thickness, interfere with each other, a subsystem for detecting a singularity which is an area within a predominantly regular contiguous object and applying a singularity processing mechanism (SPM), the subsystem comprising:

a) detecting means for detecting a singularity from said object itself; and b) generating means operatively associated with said detecting means for generating ab initio a set of embroidery interpretations representative of, and based on an input from said detecting means and relating to said singularity.

14. The system for detecting a singularity and applying a singularity processing mechanism (SPM) in accordance with claim 13, the system further comprising:

c) means for modifying said set of interpretations in order to generate a more aesthetically pleasing effect within a final generated embroidery.

15. The system for detecting a singularity and applying a singularity processing mechanism (SPM) in accordance with claim 13, wherein the elements in said set of interpretations are arranged in a predetermined order of most preferable to least preferable interpretations.

16. The system for detecting a singularity and applying a singularity processing mechanism (SPM) in accordance with claim 13, wherein said means for generating said set of interpretations comprises means for extracting structural metrics from said detected singularity.

17. The system for detecting a singularity and applying a singularity processing mechanism (SPM) in accordance with claim 16, wherein said metrics store information relating to said singularity in a structurally indexed database which is accessed by said SPM.

18. The system for detecting a singularity and applying a singularity processing mechanism (SPM) in accordance with claim 17, further comprising:

c) a singularity storage mechanism for storing said structurally indexed database.

19. The system for detecting a singularity and applying a singularity processing mechanism (SPM) in accordance with claim 18, wherein said singularity storage mechanism stores user adjustments.

20. The system for detecting a singularity and applying a singularity processing mechanism (SPM) in accordance with claim 17, wherein said system improves its performance, learning from previously encountered and stored singularities and interpretations thereof.

* * * * *